US011390361B2

(12) United States Patent
Araki et al.

(10) Patent No.: US 11,390,361 B2
(45) Date of Patent: Jul. 19, 2022

(54) PERSONAL WATERCRAFT

(71) Applicant: KAWASAKI MOTORS, LTD., Akashi (JP)

(72) Inventors: Toshio Araki, Akashi (JP); Yu Shibuta, Kobe (JP); Mayumi Takagi, Himeji (JP)

(73) Assignee: KAWASAKI MOTORS, LTD., Akashi (JP)

( * ) Notice: Subject to any disclaimer, the term of this patent is extended or adjusted under 35 U.S.C. 154(b) by 142 days.

(21) Appl. No.: 17/029,893

(22) Filed: Sep. 23, 2020

(65) Prior Publication Data

US 2022/0089257 A1 Mar. 24, 2022

(51) Int. Cl.

| | |
|---|---|
| ***B63B 34/10*** | (2020.01) |
| ***B63B 11/00*** | (2006.01) |
| *B63B 29/04* | (2006.01) |

(52) U.S. Cl.

CPC ..... *B63B 34/10* (2020.02); *B63B 11/00* (2013.01); *B63B 2029/043* (2013.01)

(58) Field of Classification Search

CPC .... B63B 34/10; B63B 11/00; B63B 2029/043

See application file for complete search history.

(56) References Cited

U.S. PATENT DOCUMENTS

| | | | | |
|---|---|---|---|---|
| 2,960,057 | A * | 11/1960 | Taylor | B63H 20/007 440/31 |
| 10,227,110 | B1 * | 3/2019 | Valence | B63H 11/04 |
| 2009/0107380 | A1 * | 4/2009 | Duquette | B63B 34/10 188/297 |
| 2022/0089257 | A1 * | 3/2022 | Araki | B63B 34/10 |

* cited by examiner

*Primary Examiner* — S. Joseph Morano
*Assistant Examiner* — Jovon E Hayes
(74) *Attorney, Agent, or Firm* — Alleman Hall Creasman & Tuttle LLP

(57) ABSTRACT

A personal watercraft includes: a watercraft body; a handle located above the watercraft body; a seat assembly including at least one straddle seat located rearward of the handle; and at least one mounting adjuster configured to mount the straddle seat on the watercraft body and allow the straddle seat to be positionable on the watercraft body in a plurality of mounting positions arranged in a front-rear direction.

16 Claims, 11 Drawing Sheets

PERSONAL WATERCRAFT

BACKGROUND

Technical Field

An aspect of the present disclosure relates to a personal watercraft.

Description of the Related Art

A personal watercraft includes a straddle seat which is located rearward of a handle and on which a user sits in a straddling position (see U.S. Pat. No. 10,227,110 B 1, for example). Different users have different physical characteristics, and it is desired that such a seat be adjustable to offer improved ride comfort to every user.

SUMMARY

A personal watercraft according to an aspect of the present disclosure includes: a watercraft body; a handle located above the watercraft body; a seat assembly including at least one straddle seat located rearward of the handle; and at least one mounting adjuster configured to mount the straddle seat on the watercraft body and allow the straddle seat to be positionable on the watercraft body in a plurality of mounting positions arranged in a front-rear direction.

In the above configuration, the position of the straddle seat on the watercraft body can be changed in the front-rear direction by the mounting adjuster for mounting the straddle seat on the watercraft body. Thus, different seating positions can be provided by the use of one and the same seat, and seat adjustment can be made depending on the user's physical characteristics or the user's preferences such as a preferred seating posture. This makes it possible to offer good seat comfort to various users.

DETAILED DESCRIPTION OF THE EMBODIMENTS

Hereinafter, exemplary embodiments will be described with reference to the drawings.

Figure 1:
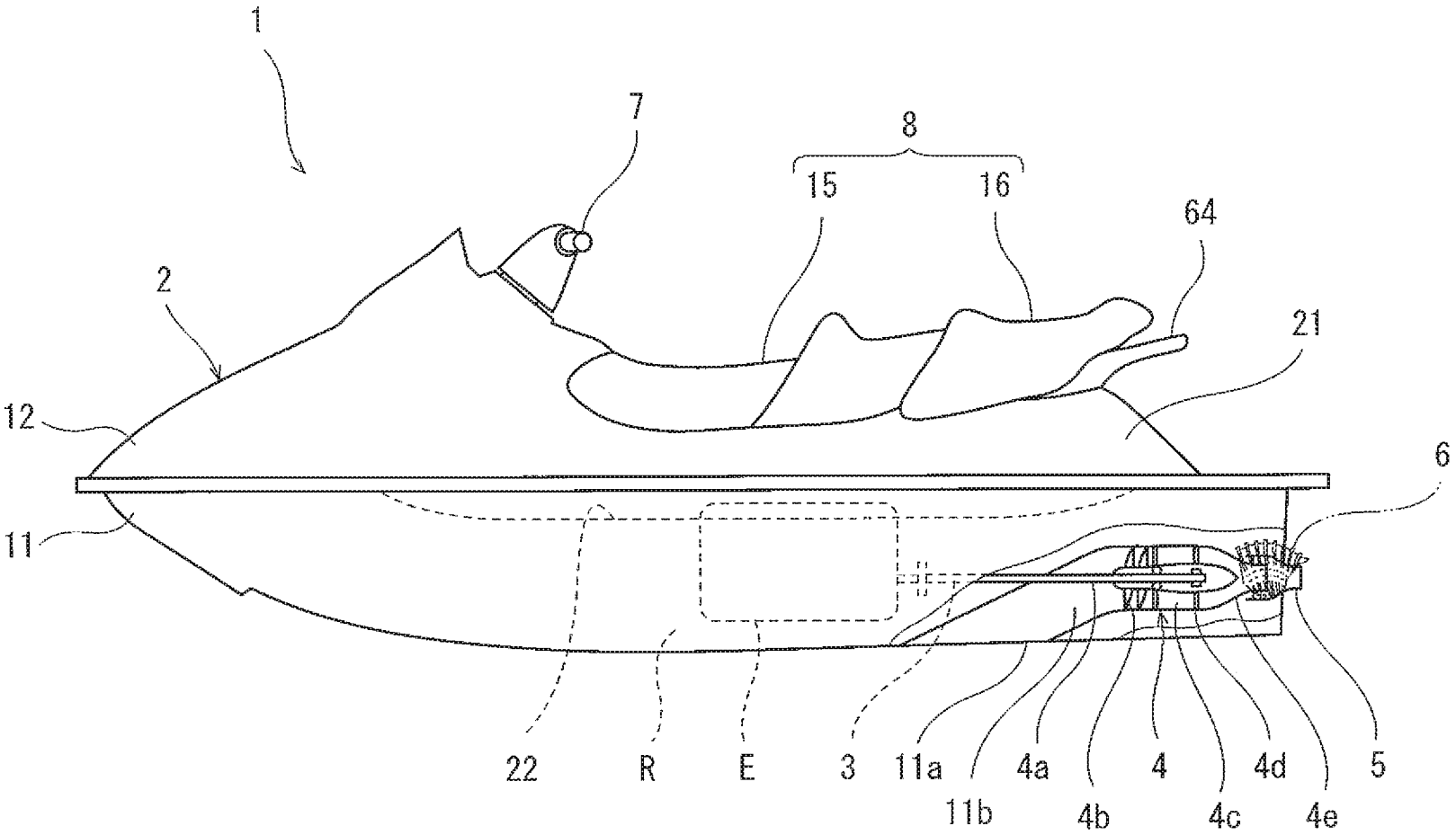
FIG. 1 is a left side view illustrating a personal watercraft according to an exemplary embodiment and showing a part of the personal watercraft in cross-section.

FIG. 1 is a left side view illustrating a personal watercraft 1 according to an exemplary embodiment and showing a part of the personal watercraft 1 in cross-section. Referring to FIG. 1, the personal watercraft 1 (hereinafter referred to as "PWC") includes a watercraft body 2, and the watercraft body 2 includes a hull 11 and a deck 12 covering the hull 11 from above. The interior of the watercraft body 2 includes an engine room R, in which an engine E serving as a prime mover is accommodated. The engine E includes an output shaft connected to a propeller shaft 3 extending rearward. The rear end of the propeller shaft 3 is connected to a pump shaft 4*a* of a water jet pump 4 located in the rear of the hull 11. An impeller 4*b* is mounted on the pump shaft 4*a*. A stator vane 4*c* is located rearward of the impeller 4*b*. A pump casing 4*d* is located radially outward of the impeller 4*b* and encloses the impeller 4*b*.

A water inlet 11*a* opens at the bottom of the hull 11. The water inlet 11*a* and the pump casing 4*d* are in communication via a water passage 11*b*. The pump casing 4*d* is provided with a pump nozzle 4*e* facing rearward of the watercraft body 2. The pump nozzle 4*e* decreases in diameter from front to rear, and an ejection orifice opens at the rear end of the pump nozzle 4*e*. To the ejection orifice of the pump nozzle 4*e* is connected a steering nozzle 5 which is swingable in the left-right direction. A bowl-shaped reverse bucket 6 is located in proximity to the steering nozzle 5. The reverse bucket 6 is pivotally supported by the hull 11 and pivotable between an advanced position where the reverse bucket 6 covers the ejection orifice of the steering nozzle 5 from behind to cause water ejected from the pump nozzle 4*e* to be redirected forward and a retracted position where the reverse bucket 6 allows the ejection orifice of the steering nozzle 5 to be open in the rearward direction.

In the PWC 1, water drawn into the hull 11 through the water inlet 11*a* located at the bottom of the hull 11 is pressurized and accelerated by rotational power of the impeller 4*b* of the water jet pump 4 driven by the engine E. The flow of water is conditioned by the stator vane 4*c* and ejected rearward through the ejection orifice of the pump nozzle 4*e* and the steering nozzle 5 to produce propulsion power. A bar-shaped handle 7 is located above the front of the deck 12 and rotatably supported by the deck 12. When the operator tilts the handle 7 to the left or right, the steering nozzle 5 swings to the left or right in conjunction with the tilting movement of the handle 7.

The deck 12 includes a seat support 21 and a pair of foot rests 22. The seat support 21 is located rearward of the handle 7 and projects upward from a deck floor of the deck 12. The deck floor is a floor on which users can walk. The foot rests 22 are located to the left and right of the seat support 21, respectively. The foot rests 22 constitute a part of the deck floor. The seat support 21 supports a seat assembly 8 from below. The seat assembly 8 includes a front seat 15 and a rear seat 16 located adjacent to and rearward of the front seat 15.

The seat assembly 8 is removable from the watercraft body 2. In the present embodiment, the front and rear seats 15 and 16 are independent of each other. The front and rear seats 15 and 16 are straddle seats on which users sit in a straddling position. The front seat 15 is a seat on which at least the operator sits. In the present embodiment, the front seat 15 is configured to allow two persons to sit thereon. Specifically, the operator and a first passenger located adjacent to and rearward of the operator can sit on the front seat 15. The rear seat 16 is configured to allow a second passenger to sit thereon. The second passenger is a person who is located adjacent to and rearward of the first passenger.

Figure 2A:
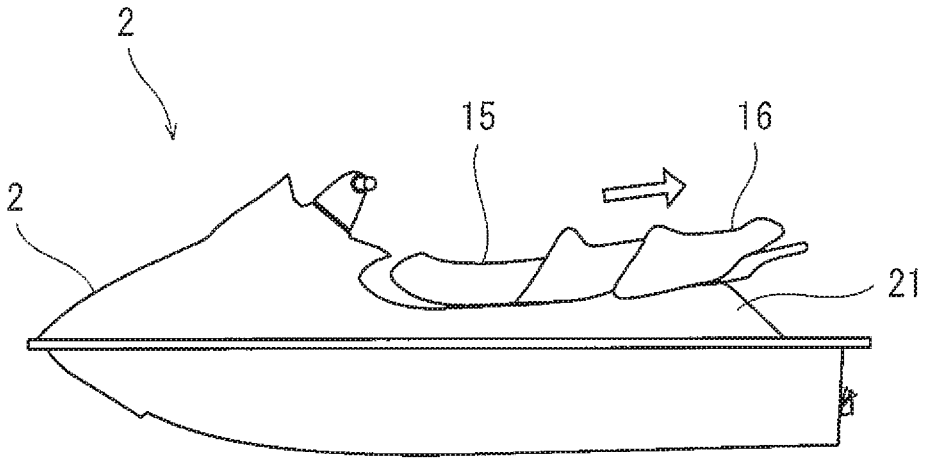
FIGS. 2A and 2B illustrate the seat position adjustment of the personal watercraft of FIG. 1.
Figure 2B:
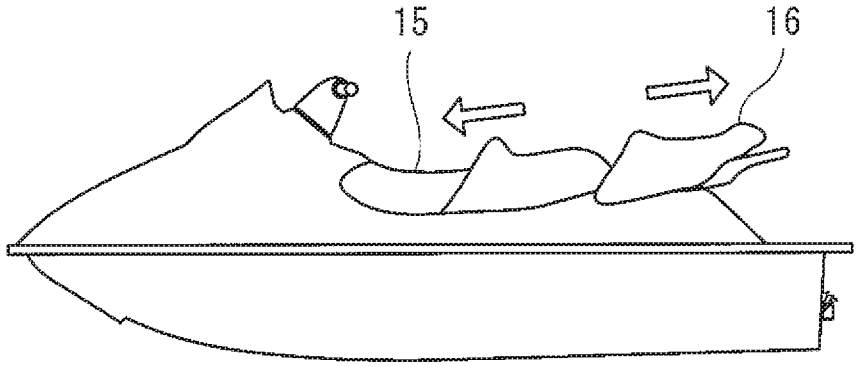

FIGS. 2A and 2B illustrate the seat position adjustment of the PWC 1 of FIG. 1. As shown in FIG. 2A, the positions of the front and rear seats 15 and 16 mounted on the watercraft body 2 can be collectively shifted rearward. Conversely, the mounting positions of the front and rear seats 15 and 16 can be collectively shifted forward. Thus, the positions of the front and rear seats 15 and 16 mounted on the watercraft body 2 can both be changed in the same direction, namely in the forward or rearward direction. As shown in FIG. 2B, the positions of the front and rear seats 15 and 16 mounted on the watercraft body 2 can be changed in such a manner that the front and rear seats 15 and 16 are moved away from each other in the front-rear direction. Conversely, the mounting positions of the front and rear seats 15 and 16 can be changed in such a manner that the front and rear seats 15 and 16 are moved toward each other in the front-rear direction. Thus, the front and rear seats 15 and 16 can be position-adjusted in a multistep fashion independently of each other. The seat assembly 8 may be configured such that the front and rear seats 15 and 16 are not independent of each other and position-adjusted together.

Figure 3:
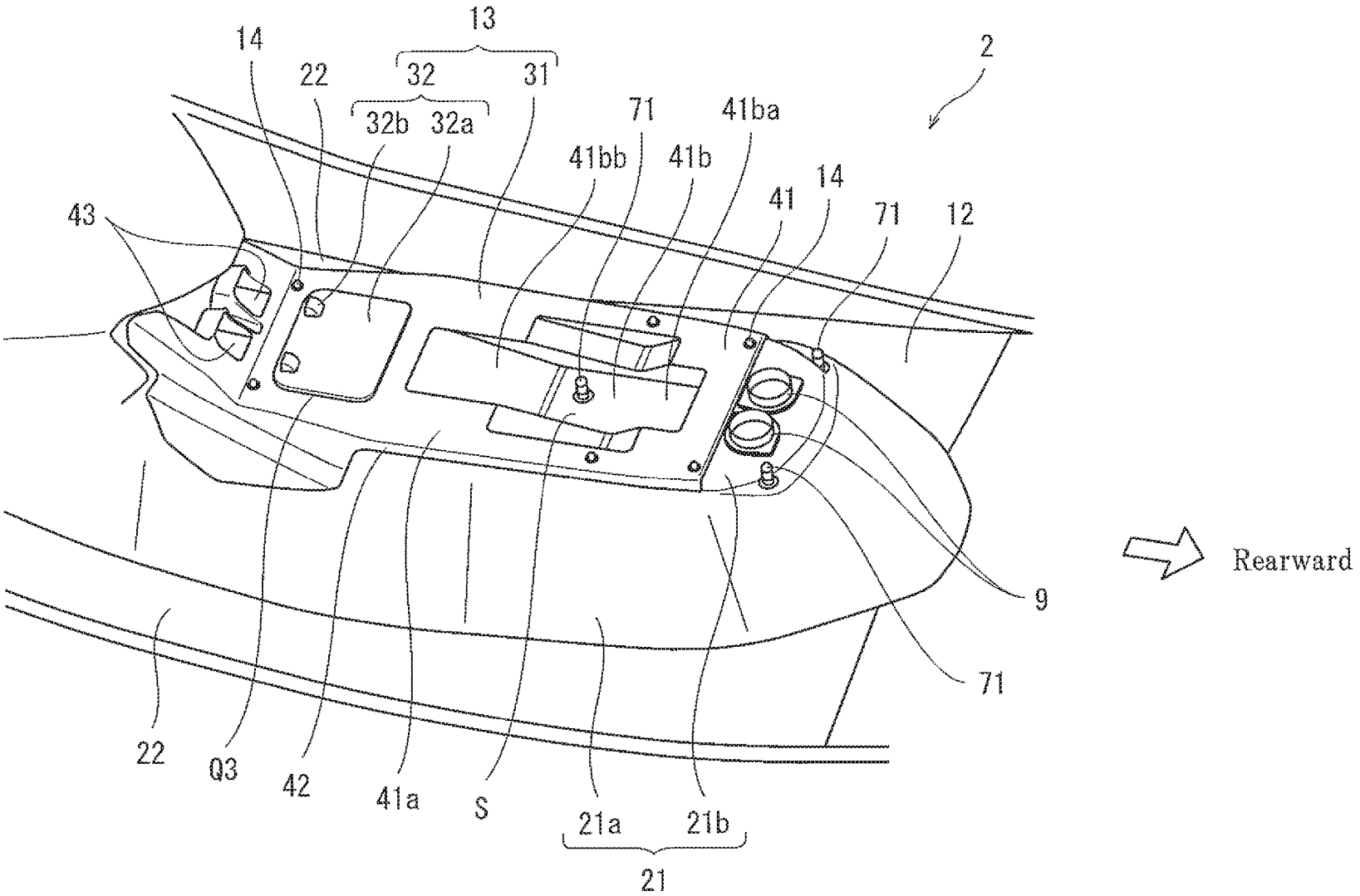
FIG. 3 is a rear left perspective view of a part of the personal watercraft of FIG. 1 with a seat assembly removed.
Figure 4:
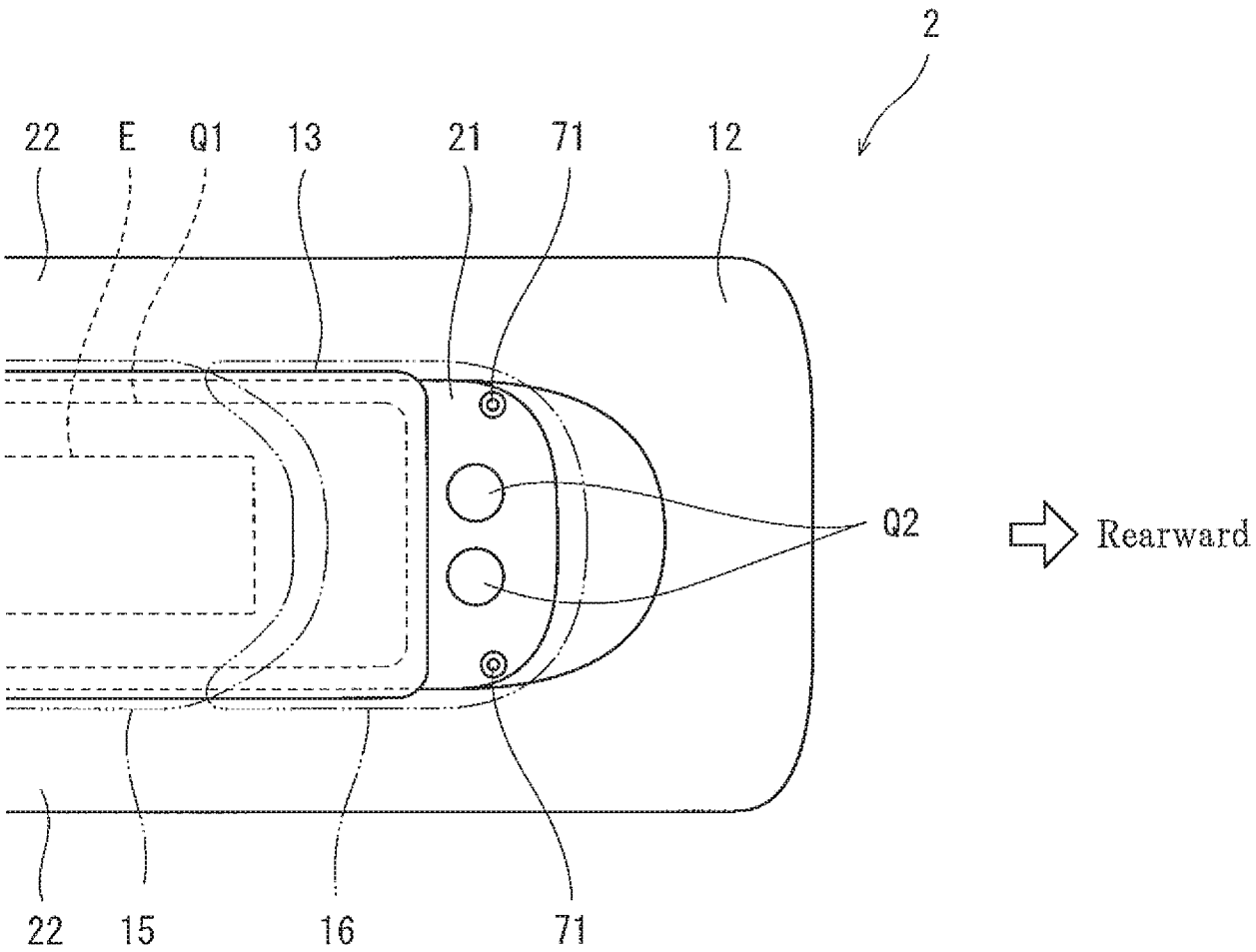
FIG. 4 is a plan view of the personal watercraft of FIG. 2 with a closure panel removed.

FIG. 3 is a rear left perspective view of a part of the PWC 1 with the seat assembly 8 removed. FIG. 4 is a plan view of the PWC 1 with a closure panel 13 removed. In FIG. 4, a recess 41*b* of the closure panel 13 and some other portions are omitted. Referring to FIGS. 3 and 4, the seat support 21 includes a peripheral wall 21*a* projecting upward from the foot rests 22 and an upper wall 21*b* connected to the upper edge of the peripheral wall 21*a*. The upper wall 21*b* of the seat support 21 is provided with an engine room opening Q1 and a pair of duct openings Q2.

The engine room opening Q1 and duct openings Q2 allow the engine room R to be open to the outside of the deck 12. In plan view, the engine room opening Q1 overlaps the engine E. In plan view, the engine room opening Q1 overlaps both of the front and rear seats 15 and 16. The duct openings Q2 are located between the rear edge of the upper wall 21*b* and the engine room opening Q1 in the front-rear direction. The duct openings Q2 are aligned in the left-right direction. Into the duct openings Q2 are inserted ventilation ducts 9 for allowing the engine room R to be open to the atmosphere. Positioning projections 71 of a pair of rear mounting adjusters 20 described later project upward from that portion of the upper wall 21*b* of the seat support 21 which is posterior to the ventilation ducts 9.

The watercraft body 2 includes the closure panel 13 mounted on top of the deck 12. The closure panel 13 is removably secured to the seat support 21 by fixing elements 14. The closure panel 13 closes the engine room opening Q1. The closure panel 13 is located forward of and spaced from the duct openings Q2. The closure panel 13 is located below and faces both of the front and rear seats 15 and 16.

The closure panel 13 includes a panel body 31 and an inspection cover 32. The panel body 31 includes an upper plate 41, a side plate 42, and insertion holes 43. The upper plate 41 closes the engine room opening Q1. The upper plate 41 is placed on top of a portion of the upper wall 21*b* of the seat support 21. The side plate 42 projects downward from the side edges of the upper plate 41. The side plate 42 extends along the peripheral wall 21*a* of the seat support 21. The closure panel 13 need not include the side plate 42. The insertion holes 43 are located forward of and above the upper plate 41. The insertion holes 43 are open at least toward the rear of the watercraft body. In the present embodiment, each insertion hole 43 is open at both ends in the front-rear direction of the watercraft body.

The upper plate 41 is provided with an inspection opening Q3. In plan view, the inspection opening Q3 overlaps an inspection-requiring portion which is related to the engine E and which is frequently inspected (e.g., a portion for oil check). The inspection opening Q3 is closed from above by the inspection cover 32. The inspection cover 32 includes a plate portion 32*a* that closes the inspection opening Q3 and grip portions 32*b* provided on the upper surface of the plate portion 32*a*. The inspection cover 32 is mounted on the panel body 31 to close the inspection opening Q3 and is removable to uncover the inspection opening Q3.

The upper surface of the panel body 31 of the closure panel 13 includes a top surface 41*a* and a recess 41*b*. The recess 41*b* extends downward from the top surface 41*a* and defines a space S. At least a portion of the bottom of the recess 41*b* is a horizontal surface 41*bb* which extends in a horizontal direction when the PWC 1 is at rest on the water. The front edge of the horizontal surface 41*bb* is smoothly continuous with the top surface 41*a*. The recess 41*b* includes an inclined surface 41*ba* adjacent to and rearward of the horizontal surface 41*bb*. The inclined surface 41*ba* is inclined upward from front to rear when the PWC 1 is at rest on the water. That is, the normal to the inclined surface 41*ba* extends upward and forward. A positioning projection 71 of a front mounting adjuster 10 described later projects upward from the inclined surface 41*ba* of the recess 41*b*.

Figure 5:
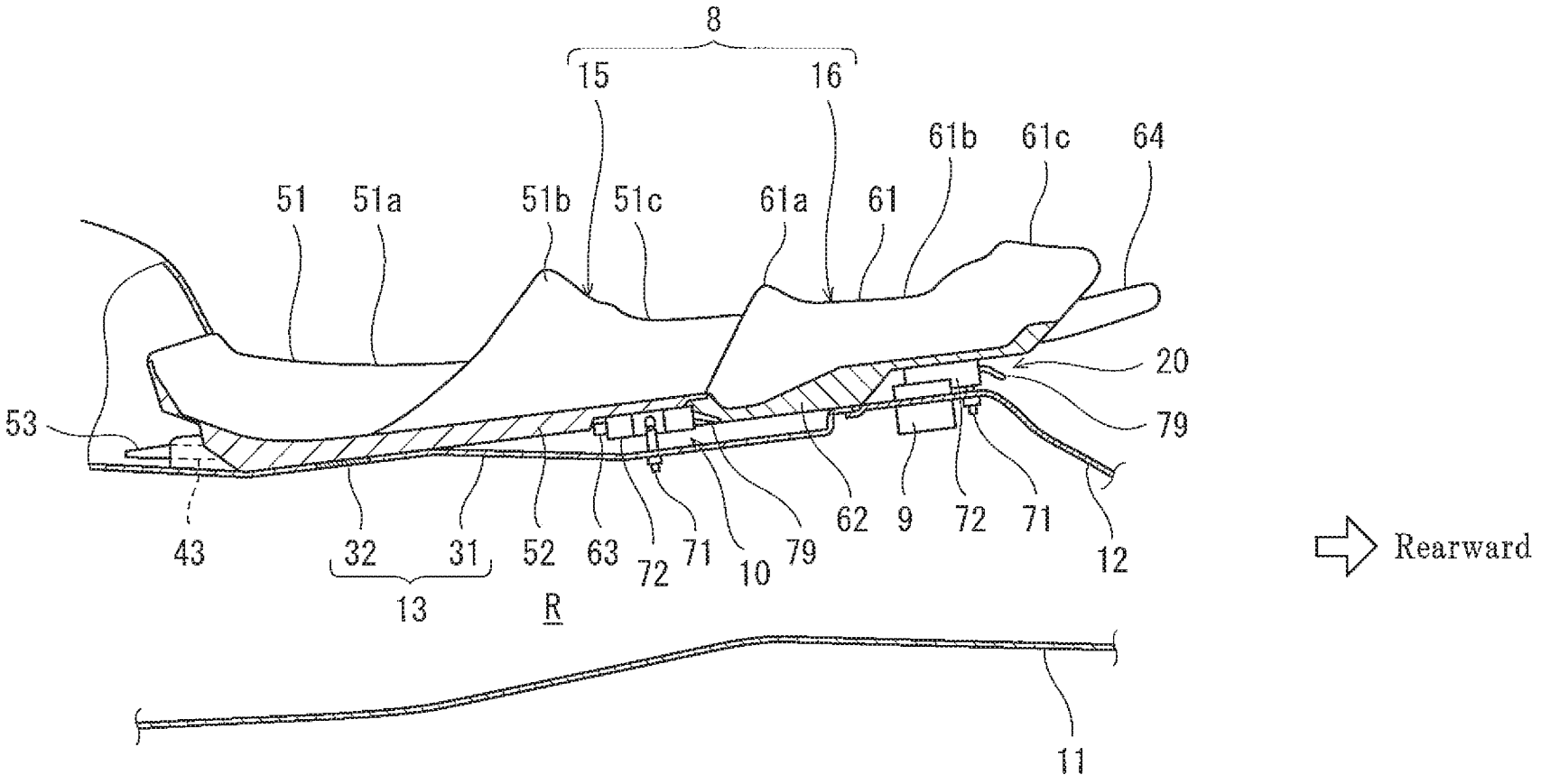
FIG. 5 is a vertical cross-sectional view of a part of the personal watercraft of FIG. 1 as seen from the left.
Figure 6:
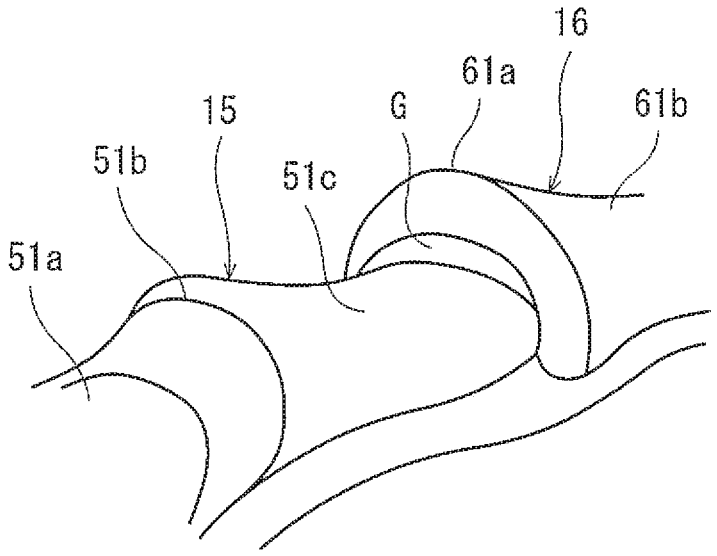
FIG. 6 is a front perspective view of front and rear seats of FIG. 5.
Figure 7:
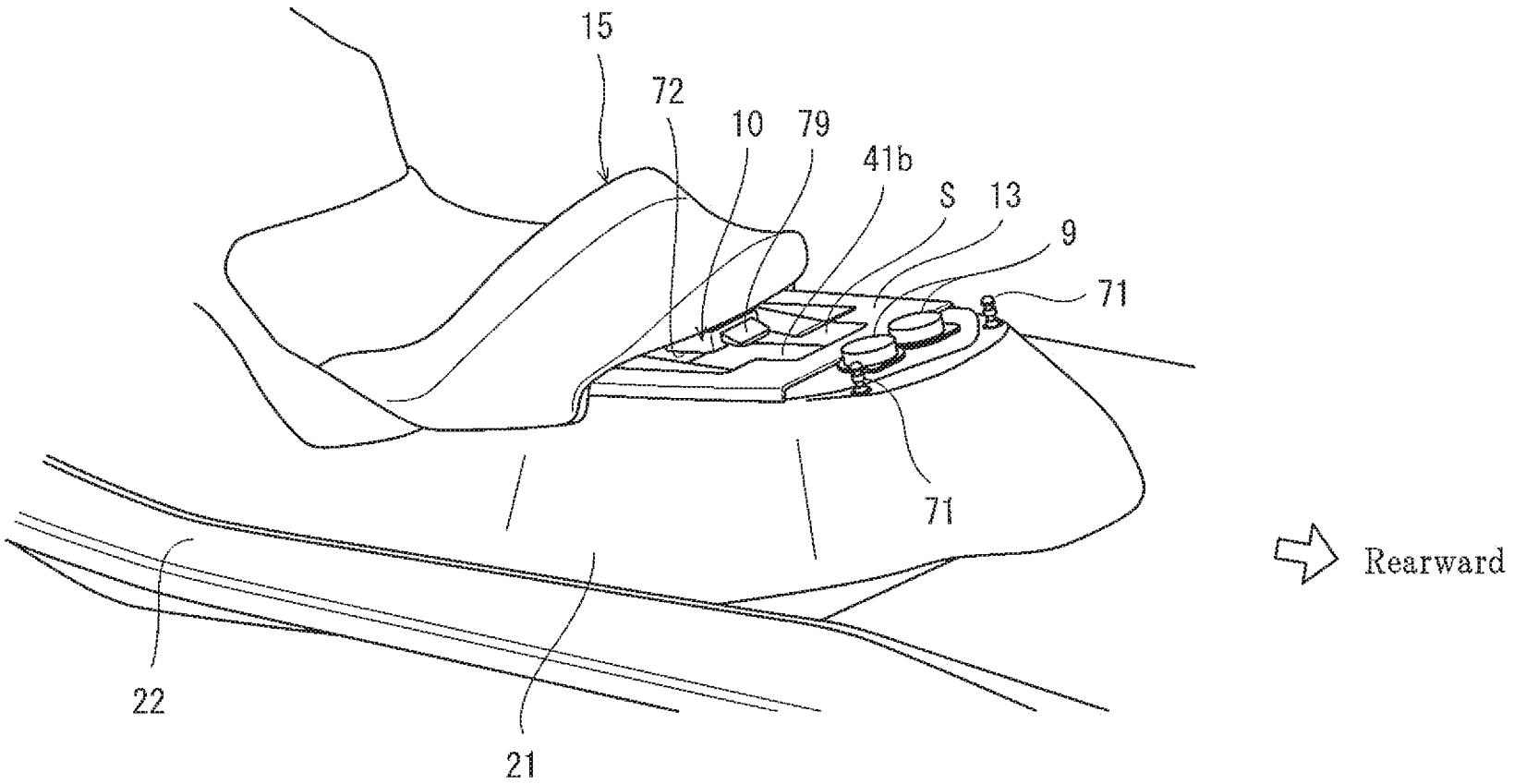
FIG. 7 is a rear left perspective view of a part of the personal watercraft of FIG. 1 with the rear seat removed.
Figure 8A:
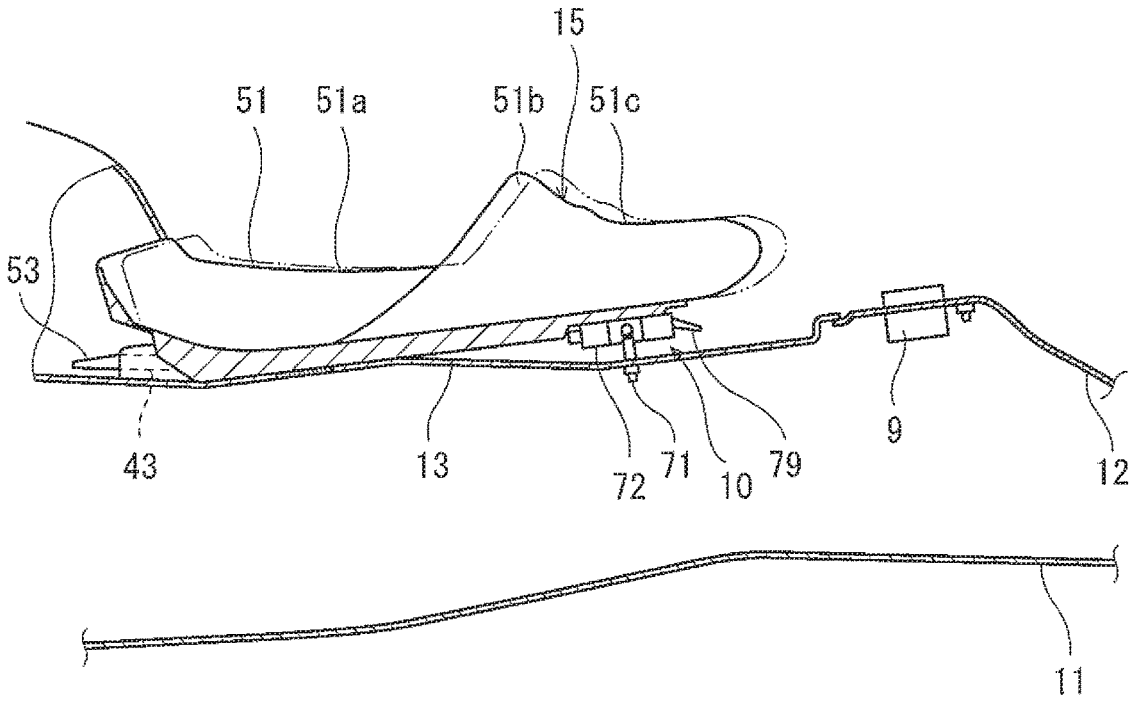
FIG. 8A illustrates the position adjustment of the front seat of FIG. 5.
Figure 8B:
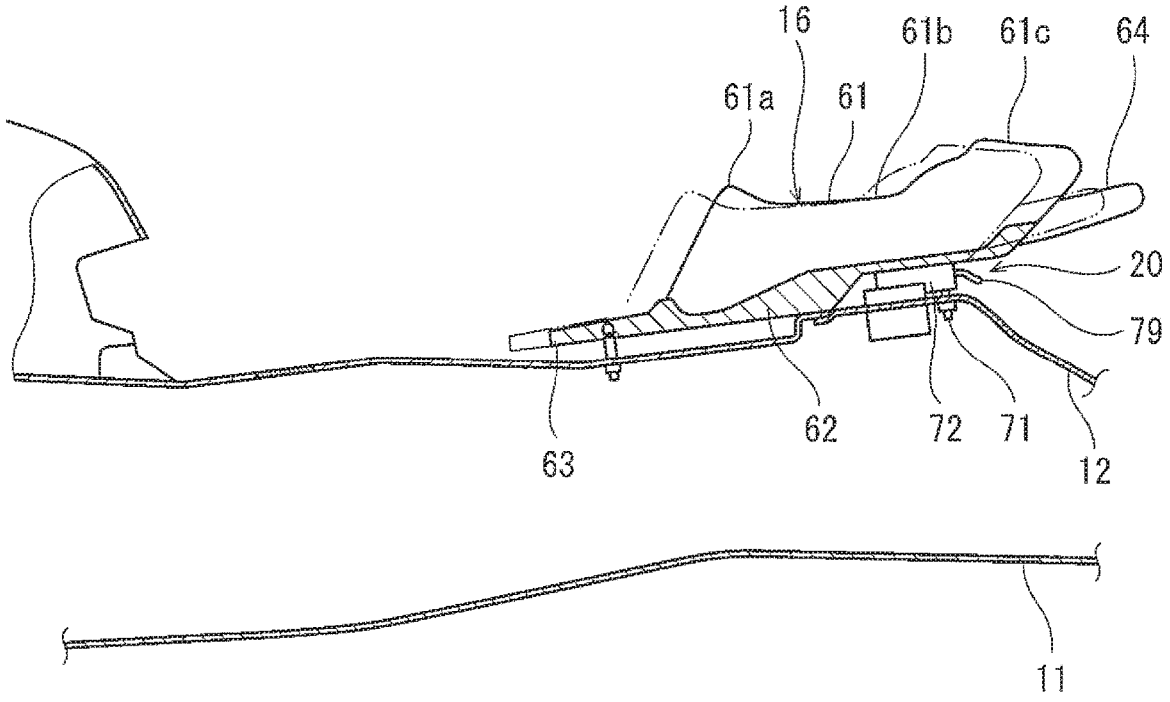
FIG. 8B illustrates the position adjustment of the rear seat of FIG. 5.

FIG. 5 is a vertical cross-sectional view of a part of the PWC 1 of FIG. 1 as seen from the left. FIG. 6 is a front perspective view of the front and rear seats 15 and 16 of FIG. 5. FIG. 7 is a rear left perspective view of a part of the PWC 1 of FIG. 1 with the rear seat 16 removed. FIG. 8A illustrates the position adjustment of the front seat 15 of FIG. 5. FIG. 8B illustrates the position adjustment of the rear seat 16 of FIG. 5. Referring to FIG. 5, the front seat 15 includes a front cushion 51 and a front bottom plate 52. The rear seat 16 includes a rear cushion 61 and a rear bottom plate 62. In plan view, a rear end portion of the front seat 15 and a front end portion of the rear seat 16 overlap the closure panel 13 regardless of in which position the seat assembly 8 is mounted. The rear seat 16 covers the ventilation ducts 9 from above. There is a gap between the rear seat 16 and the ventilation ducts 9.

Referring to FIGS. 5 and 6, the front cushion 51 includes a front bottom support 51*a*, a hip support 51*b*, and a rear bottom support 51*c*. The front bottom support 51*a* is a front part of the front cushion 51 and supports the hips of the operator from below. The hip support 51*b* is configured to support the hips of the operator from behind when the operator sits on the front bottom support 51*a*. Specifically, the hip support 51*b* is adjacent to and rearward of the front bottom support 51*a* and projects upward from the rear end of the front bottom support 51*a*. The front cushion 51 as viewed in the front-rear direction is in the shape of an upwardly convex arch. In the thus shaped front cushion 51, the hip support 51*b* projects upward with respect to the front bottom support 51*a* and exhibits an arch shape.

When the PWC 1 is at rest on the water, the difference between the vertical height of a portion of the front bottom support 51*a* that is immediately adjacent to the hip support

51*b* and the vertical height of the hip support 51*b* is, for example, in the range of 5 to 20 cm and preferably in the range of 10 to 15 cm, although the difference between the vertical heights is not limited to these ranges.

The rear bottom support 51*c* is a seat portion which is adjacent to and rearward of the hip support 51*b* and which has a lower height than the hip support 51*b*. The rear bottom support 51*c* located adjacent to and rearward of the operator supports the hips of the first passenger from below. The rear end portion of the rear bottom support 51*c* is inserted into a space beneath the rear seat 16 through the front opening of the space. Specifically, both in plan view and in side view, the arched rear edge of the front seat 15 is covered by the arched front end portion of the rear seat 16. The seat assembly 8 may be configured such that the front end portion of the rear seat 16 is inserted into a space beneath the front seat 15 through the rear opening of the space.

The front bottom plate 52 is located below and secured to the front cushion 51. The front bottom plate 52 is located above and faces the closure panel 13. Ahead of the front bottom plate 52 are located engaging projections 53 extending forward. The engaging projections 53 are formed integrally with the front bottom plate 52 by one-piece molding. To the rear end portion of the front bottom plate 52 is secured a receiver 72 of the front mounting adjuster 10. The engaging projections 53 of the front seat 15 are inserted into the insertion holes 43 of the closure panel 13 through the rear openings of the insertion holes 43, and thus the receiver 72 of the front mounting adjuster 10 is connected to the watercraft body 2, so that the front seat 15 is secured to the watercraft body 2. As seen from FIG. 5, if the rear seat 16 is removed from the watercraft body 2, a user operable structure 79 of the front mounting adjuster 10 is exposed toward the rear of the watercraft body 2. The details of the configuration of the front mounting adjuster 10 will be described later.

The rear cushion 61 includes a front hip support 61*a*, a bottom support 61*b*, and a rear hip support 61*c*. The front hip support 61*a* is configured to support the hips of the first passenger from behind when the first passenger sits on the rear bottom support 51*c* of the front seat 15. Specifically, the front hip support 61*a* is an upwardly projecting front end portion of the rear cushion 61 and is adjacent to and rearward of the rear bottom support 51*c* of the front seat 15. The front hip support 61*a* as viewed in the front-rear direction is arched and projects upward with respect to the rear bottom support 51*c*.

When the PWC 1 is at rest on the water, the difference between the vertical height of a portion of the rear bottom support 51*c* that is immediately adjacent to the front hip support 61*a* and the vertical height of the front hip support 61*a* is, for example, in the range of 3 to 15 cm and preferably in the range of 5 to 10 cm, although the difference between the vertical heights is not limited to these ranges.

The bottom support 61*b* is a seat portion which is adjacent to and rearward of the front hip support 61*a* and which has a lower height than the front hip support 61*a*. The bottom support 61*b* supports the hips of the second passenger from below. The rear hip support 61*c* is configured to support the hips of the second passenger from behind when the second passenger sits on the bottom support 61*b*. Specifically, the rear hip support 61*c* is adjacent to and rearward of the bottom support 61*b* and projects upward from the rear end of the bottom support 61*b*. When the PWC 1 is at rest on the water, the difference between the maximum vertical height of the bottom support 61*b* and the maximum vertical height of the rear hip support 61*c* is, for example, in the range of 2 to 10 cm and preferably in the range of 4 to 8 cm, although the difference between the maximum vertical heights is not limited to these ranges.

The rear bottom plate 62 is located below and secured to the rear cushion 61. The rear bottom plate 62 is located above and faces the closure panel 13 and the ventilation ducts 9. A hand grip 64 is secured to the rear bottom plate 62. The hand grip 64 projects rearward beyond the rear cushion 61. The hand grip 64 can be held by a user when the user moves on the deck 12 or when the user gets onto the watercraft body 2 from the water. The hand grip 64 is U-shaped. The two front ends of the hand grip 64 are secured to the rear bottom plate 62, and the arched portion of the hand grip 64 extends rearward. Ahead of the rear bottom plate 62 is located an engaging projection 63 extending forward. The engaging projection 63 is formed integrally with the rear bottom plate 62 by one-piece molding. To the rear end portion of the rear bottom plate 62 are secured receivers 72 of the pair of rear mounting adjusters 20. The rear mounting adjusters 20 are spaced apart from each other in the left-right direction.

The engaging projection 63 of the rear seat 16 is inserted into the space beneath the front bottom plate 52 of the front seat 15 through the rear opening of the space, and thus the receivers 72 of the rear mounting adjusters 20 are connected to the watercraft body 2, so that the rear seat 16 is secured to the watercraft body 2. The user operable structures 79 of the rear mounting adjusters 20 are exposed toward the rear of the watercraft body 2 to which the rear seat 16 has been secured (see FIG. 7). The configuration of the rear mounting adjusters 20 is the same as the configuration of the front mounting adjuster 10 which will be described later. Thus, a particular description of the configuration of the rear mounting adjusters 20 will not be given.

Referring to FIG. 8A, the front mounting adjuster 10 is configured to allow the front seat 15 to be mountable on the watercraft body 2 in a plurality of mounting positions (e.g., three mounting positions) arranged in the front-rear direction. Referring to FIG. 8B, the rear mounting adjusters 20 are configured to allow the rear seat 16 to be mountable on the watercraft body 2 in a plurality of mounting positions (e.g., three mounting positions) arranged in the front-rear direction. Thus, the mounting position of the front seat 15 and the mounting position of the rear seat 16 are changeable independently of each other. Combinations of the mounting positions provided by the front mounting adjuster 10 and the mounting positons provided by the rear mounting adjusters 20 include a first combination in which the front seat 15 and the rear seat 16 are maximally close to each other and a plurality of second combinations other than the first combination.

When mounted using any of the second combinations, the front and rear seats 15 and 16 are spaced by a gap G. The front end portion of the rear cushion 61 is shaped to cover the gap G formed between the front and rear seats 15 and 16 mounted using the second combination. Specifically, when the front and rear seats 15 and 16 are mounted using any of the second combinations, the rear end portion of the front cushion 51 is inserted into the space beneath the rear seat 16 through the front opening of the space. Thus, both in plan view and in side view, the rear edge of the front seat 15 is covered by the front end portion of the rear seat 16. When mounted using the first combination, the front and rear seats 15 and 16 may be in contact without any gap G or spaced by a gap G in the front-rear direction.

Figure 9:
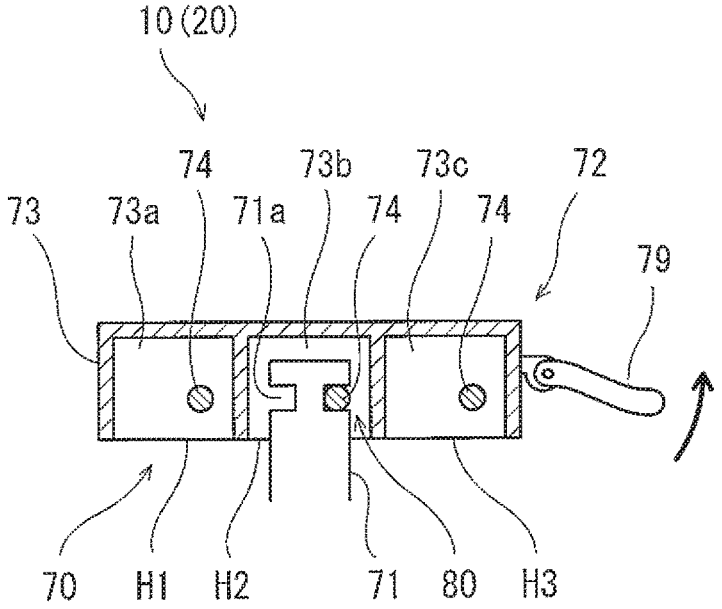
FIG. 9 is a vertical cross-sectional view of a mounting adjuster of FIG. 7 as seen from the left.
Figure 10:
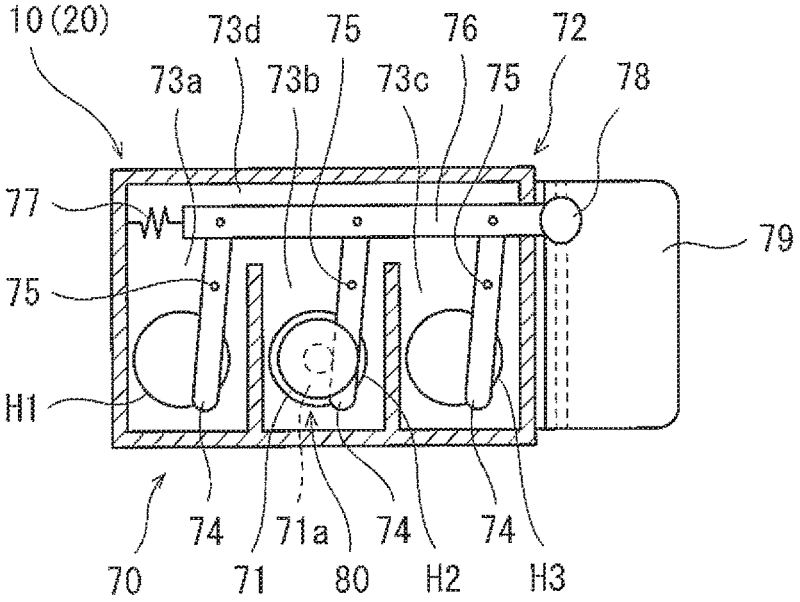
FIG. 10 is a horizontal cross-sectional view of the mounting adjuster of FIG. 9.
Figure 11:
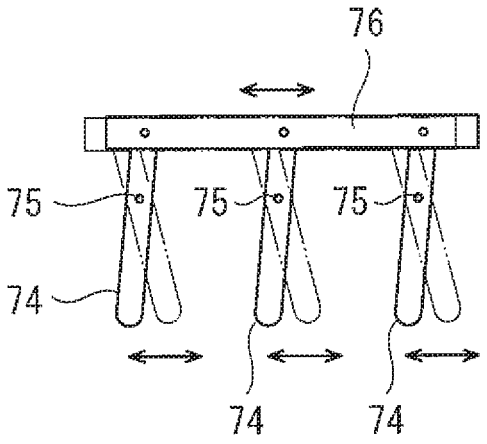
FIG. 11 illustrates the operation of the mounting adjuster of FIG. 10.

FIG. 9 is a vertical cross-sectional view of the mounting adjuster 10 of FIG. 7 as seen from the left. FIG. 10 is a horizontal cross-sectional view of the mounting adjuster 10 of FIG. 9. FIG. 11 illustrates the operation of the mounting adjuster 10 of FIG. 10. The front mounting adjuster 10 and rear mounting adjusters 20 have the same configuration. Hereinafter, the configuration of the front mounting adjuster 10 will be descried. Referring to FIGS. 9 and 10, the front mounting adjuster 10 includes the positioning projection 71 and the receiver 72. The positioning projection 71 is secured to the bottom surface of the recess 41*b* of the closure panel 13 and projects upward toward the front seat 15 (see FIG. 5). The positioning projection 71 is, for example, substantially in the shape of a circular cylinder. The positioning projection 71 includes an engagement receiving structure 71*a*. The engagement receiving structure 71*a* is, for example, an annular recess formed in the outer circumferential surface of the positioning projection 71 and extending around the axis of the positioning projection 71.

The receiver 72 is secured to the front seat 15. The receiver 72 is located above and faces the positioning projection 71. The receiver 72 includes a housing 73, a plurality of engaging structures 74, a plurality of support shafts 75, a coupling structure 76, a spring 77, a drive force conversion structure 78, and a user operable structure 79. The housing 73 includes a first positioning space 73*a*, a second positioning space 73*b*, a third positioning space 73*c*, and a shared space 73*d*. The first to third positioning spaces 73*a* to 73*c* are separate spaces arranged in the front-rear direction and divided from one another. The shared space 73*d* is adjacent to all of the first to third positioning spaces 73*a* to 73*c* in the left-right direction and is in communication with each of the first to third positioning spaces 73*a* to 73*c*.

The bottom of the housing 73 is provided with first to third positioning holes H1 to H3 arranged in the front-rear direction. The first positioning hole H1 allows the first positioning space 73*a* to open downward. The second positioning hole H2 allows the second positioning space 73*b* to open downward. The third positioning hole H3 allows the third positioning space 73*c* to open downward. The positioning projection 71 is inserted from below into a hole arbitrarily selected from the first to third positioning holes H1 to H3, so that the position of the front seat 15 in the horizontal direction is fixed on the watercraft body 2.

The number of the engaging structures 74 and the number of the support shafts 75 are the same as the number of the first to third positioning holes H1 to H3. The three sets of the engaging structure 74 and the support shaft 75 are associated with the first to third positioning holes H1 to H3, respectively. The engaging structure 74 is, for example, an engaging rod. The engaging structure 74 is swingable about the support shaft 75 provided in the housing 73. The coupling structure 76 is located in the shared space 73*d*. The coupling structure 76 is, for example, a coupling rod. The coupling structure 76 is pivotally connected to the proximal ends of the three engaging structures 74.

Referring to FIGS. 10 and 11, when the coupling structure 76 moves to one side in the front-rear direction, the three engaging structures 74 swing together in a first direction about the support shafts 75, and the distal ends of the three engaging structures 74 move to engagement positions. As a result, one of the three engaging structures 74 is engaged with the engagement receiving structure 71*a* of the positioning projection 71 to block the front seat 15 from moving upward away from the watercraft body 2 (the front seat shown in FIGS. 6 and 7 is in this engaged state). When the coupling structure 76 moves to the opposite side in the front-rear direction, the three engaging structures 74 swing together in a second direction about the support shafts 75, and the distal ends of the three engaging structures 74 move to disengagement positions. As a result, all of the three engaging structures 74 are disengaged from the engagement receiving structure 71*a* of the positioning projection 71. The engaging structures 74 are biased by the spring 77 toward the engagement positions.

The user operable structure 79 is located rearward of the housing 73. The user operable structure 79 is configured to transmit a drive force to the coupling structure 76 through the drive force conversion structure 78. The user operable structure 79 is swingably connected to the housing 73 so that the rear end portion of the user operable structure 79 is movable in the up-down direction. The drive force conversion structure 78 converts swinging motion of the user operable structure 79 in the up-down direction to linear motion of the coupling structure 76 in the front-rear direction. The drive force conversion structure 78 may be, for example, a cam structure in which the front end surface of the user operable structure 79 is in contact with the rear end surface of the coupling structure 76. The drive force conversion structure 78 need not necessarily be used. The user operable structure 79 may be configured to move linearly, and the linear motion of the user operable structure 79 may be transmitted directly to the coupling structure 76.

When the user operable structure 79 is moved upward by a hand, the coupling structure 76 moves in the front-rear direction against the spring 77, and the three engaging structures 74 move together to the disengagement positions. As a result, one of the engaging structures 74 which had been engaged with the engagement receiving structure 71*a* becomes disengaged from the engagement receiving structure 71*a*.

The positioning projection 71 and the first to third positioning holes H1 to H3 constitute a positioner 70 of the mounting adjuster 10. The positioner 70 is configured to place the front seat 15 on the watercraft body 2 in a mounting position selected from three mounting positions arranged in the front-rear direction. The engagement receiving structure 71*a*, engaging structures 74, support shafts 75, coupling structure 76, spring 77, drive force conversion structure 78, and user operable structure 79 constitute a lock 80 of the mounting adjuster 10. The lock 80 is configured to switch between a state where the front seat 15 is locked to the watercraft body 2 and a state where the front seat 15 is unlocked from the watercraft body 2.

When the positioning projection 71 is inserted into the first positioning hole H1 and the associated engaging structure 74 is engaged with the engagement receiving structure 71*a*, the front seat 15 is mounted on the watercraft body 2 in a foremost mounting position. When the positioning projection 71 is inserted into the third positioning hole H3 and the associated engaging structure 74 is engaged with the engagement receiving structure 71*a*, the front seat 15 is mounted on the watercraft body 2 in a rearmost mounting position. When the positioning projection 71 is inserted into the second positioning hole H2 and the associated engaging structure 74 is engaged with the engagement receiving structure 71*a*, the front seat 15 is mounted on the watercraft body 2 in a middle mounting position intermediate between the foremost mounting position and the rearmost mounting position. Thus, the front mounting adjuster 10 allows the mounting position of the front seat 15 on the watercraft body 2 to be changeable in the front-rear direction. The rear mounting adjusters 20 operate on the same principle as the front mounting adjuster 10 to allow the mounting position of the rear seat 16 on the watercraft body 2 to be changeable in the front-rear direction.

In the configuration described above, the positions of the seats 15 and 16 on the watercraft body 2 can be changed in the front-rear direction. Thus, different seating positions can be provided by the use of one and the same seat, and seat adjustment can be made depending on the user's physical characteristics or the user's preferences such as a preferred seating posture. This makes it possible to offer good seat comfort to various users. Additionally, since changes of the positions of the seats 15 and 16 are accompanied by changes of the positions of the hip supports 51*b*, 61*a*, and 61*c*, good seat comfort can be reliably provided.

Since the position of the front seat 15 on which at least the operator sits can be changed in the front-rear direction, good seat comfort can be offered to the operator. Since the front and rear seats 15 and 16 can be position-adjusted independently of each other, both the seat comfort experienced by the operator and first passenger sitting on the front seat 15 and the seat comfort experienced by the second passenger sitting on the rear seat 16 can be optimized.

The rear end portion of the front cushion 51 or the front end portion of the rear cushion 61 is shaped such that when the front and rear seats 15 and 16 are spaced by the gap Gin the front-rear direction, the rear or front end portion covers the gap G. Thus, the gap G is inconspicuous even if the mounting positons of the front and rear seats 15 and 16 are changed to those where the front and rear seats 15 and 16 are spaced by the gap G. While an engine room opening of a conventional PWC is sealed by a seat serving as a lid, the engine room opening Q1 is closed by the closure panel 13. This eliminates the need for endowing the seat assembly 8 with a sealing function. Thus, the seat assembly 8 can be provided with a slide mechanism without having to complicate the configuration of the seat assembly 8.

The closure panel 13 includes the panel body 31 provided with the inspection opening Q3 and the inspection cover 32 removably mounted to close the inspection opening Q3. Thus, when inspection work for the engine E (such as oil check) is performed, the entire closure panel 13 need not be removed, and only the inspection cover 32 has to be removed to access the engine E through the inspection opening Q3. As such, both watertightness and ease of inspection can be ensured.

Since the front mounting adjuster 10 is located in the space S defined by the recess 41*b* of the closure panel 13, the size of the space beneath the seat assembly 8 can be reduced to prevent a size increase of the seat assembly 8 in the up-down direction. The recess 41*b* of the closure panel 13 has the horizontal surface 41*bb* smoothly continuous with the top surface 41*a*, and thus water entering the recess 41*b* is easily discharged outside (forward from) the recess 41*b*.

Since the positioner 70 of each of the mounting adjusters 10 and 20 provides for a plurality of mounting positions, each of the seats 15 and 16 is mountable on the watercraft body 2 in a plurality of positions arranged in the front-rear direction. Since the positioning projection 71 of each of the mounting adjusters 10 and 20 is provided with the engagement receiving structure 71*a*, the positioning projection 71 can serve as a component of both the positioner 70 and the lock 80, and this allows for a simplified configuration of the mounting adjusters 10 and 20. Since the engaging structures 74 and the user operable structure 79 are provided in the seats 15 and 16, the watercraft body 2 can be simplified, and large areas can be allocated to the cushion portions of the seats 15 and 16.

The user operable structure 79 causes the plurality of engaging structures 74 to move together; that is, one user operable structure 79 is sufficient to move the plurality of engaging structures 74. This allows for simplification of the configuration and enables the user to disengage the engaging structures 74 by operating one and the same user operable structure 79 regardless of the changes of the mounting positions of the seats 15 and 16. Thus, the user friendliness is improved.

Since the hand grip 64 is secured to the rear seat 16 rather than to the watercraft body 2, there is no need for changing the position of the hand grip 64 when changing the mounting position of the rear seat 16 on the watercraft body 2. The two rear mounting adjusters 20 for the rear seat 16 with the hand grip 64 secured thereto are spaced apart from each other in the left-right direction. Thus, the rear seat 16 mounted on the watercraft body 2 can be stably held in place even when a load acting leftward or rightward is applied to the hand grip 64.

Figure 12A:
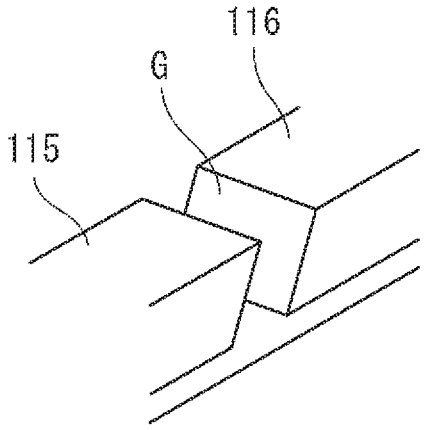
FIG. 12A is a perspective view of a first variant of the front and rear seats of FIG. 6.

FIG. 12A is a perspective view of a first variant of the front and rear seats shown in FIG. 6. Referring to FIG. 12A, the front and rear seats 115 and 116 are shaped such that the rear edge of the front seat 115 covers the front end portion of the rear seat 116 in plan view and that the gap G between the front and rear seats 115 and 116 is open in the left-right direction in side view. The front and rear seats 115 and 116 may be shaped such that the front edge of the rear seat 116 covers the rear end portion of the front seat 115 in plan view and that the gap G between the front and rear seats 115 and 116 is open in the left-right direction in side view.

Figure 12B:
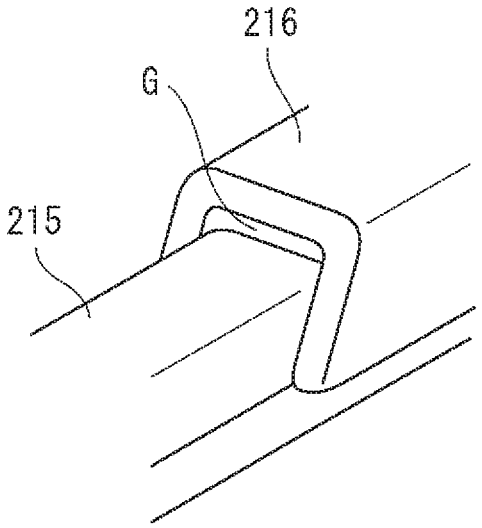
FIG. 12B is a perspective view of a second variant of the front and rear seats of FIG. 6.

FIG. 12B is a perspective view of a second variant of the front and rear seats shown in FIG. 6. Referring to FIG. 12B, the front and rear seats 215 and 216 are shaped such that the front edge of the rear seat 216 covers the rear end portion of the front seat 215 in side view and that the gap G between the front and rear seats 215 and 216 is open in the upward direction in plan view. The front and rear seats 215 and 216 may be shaped such that the rear end portion of the front seat 215 covers the front edge of the rear seat 216 in side view and that the gap G between the front and rear seats 215 and 216 is open in the upward direction in plan view.

Many modifications and other embodiments of the present invention will be apparent to those skilled in the art from the foregoing description. Accordingly, the foregoing description is to be construed as illustrative only, and is provided for the purpose of teaching those skilled in the art the best mode for carrying out the invention. The details of the structure and/or function may be varied substantially without departing from the scope of the invention.

While in the above embodiment the positioner 70 includes a plurality of positioning holes H1 to H3 and one positioning projection 71, the positioner 70 may include one positioning hole and a plurality of positioning projections. One of the front and rear seats 15 and 16 may be capable of position adjustment in the front-rear direction, while the other of the front and rear seats 15 and 16 may be incapable of position adjustment in the front-rear direction. The PWC 1 may be a two-seater PWC in which each of the front and rear seats 15 and 16 is configured for seating of one person. In this case, for example, one of the hip support 51*b* and the front hip support 61*a*, in particular the hip support 51*b*, need not be provided.

The seat assembly 8 may include only one straddle seat. The front end portion of the rear cushion 61 may be inserted into the space beneath the rear end portion of the front cushion 51. In this case, the rear end portion of the front cushion 51 may cover the front end portion of the rear cushion 61. The male-female relationship in fitting of the engagement structures 74 and the engagement receiving structure 71*a* may be reversed. The configurations of the positioner 70 and the lock 80 are not limited to those described above, and any other known configurations may be used. The mounting adjusters 10 and 20 are not limited to those of the embodiment described above, and may be rails capable of sliding in the front-rear direction and being held in a fixed position in the front-rear direction.

What is claimed is:

1. A personal watercraft comprising:

a watercraft body;

a handle located above the watercraft body;

a seat assembly comprising at least one straddle seat located rearward of the handle; and at least one mounting adjuster configured to mount the straddle seat on the watercraft body and allow the straddle seat to be positionable on the watercraft body in a plurality of mounting positions arranged in a front-rear direction.

2. The personal watercraft according to claim 1, wherein the straddle seat comprises a hip support.

3. The personal watercraft according to claim 1, wherein the straddle seat is an operator seat on which at least an operator sits.

4. The personal watercraft according to claim 1, wherein the seat assembly comprises a front seat on which at least an operator sits and a rear seat independent of the front seat and located adjacent to and rearward of the front seat, and the at least one straddle seat includes at least one of the front and rear seats.

5. The personal watercraft according to claim 4, wherein the at least one straddle seat includes the front seat and the rear seat, the at least one mounting adjuster includes: a front mounting adjuster configured to allow the front seat to be mountable on the watercraft body in a plurality of front seat mounting positions arranged in the front-rear direction; and a rear mounting adjuster configured to allow the rear seat to be mountable on the watercraft body in a plurality of rear seat mounting positions arranged in the front-rear direction, and the mounting position of the front seat and the mounting position of the rear seat are changeable independently of each other.

6. The personal watercraft according to claim 5, wherein the front seat comprises a front cushion and a front bottom plate located below the front cushion, the rear seat comprises a rear cushion and a rear bottom plate located below the rear cushion, combinations of the front seat mounting positions and the rear seat mounting positions include a first combination in which the front seat and the rear seat are maximally close to each other and at least one second combination other than the first mounting position, the front and rear seats are spaced by a gap in the front-rear direction when mounted using the second combination, and a rear end portion of the front cushion or a front end portion of the rear cushion is shaped to cover the gap between the front and rear seats mounted using the second combination.

7. The personal watercraft according to claim 4, wherein the watercraft body comprises: a deck provided with an engine room opening overlapping both the front seat and the rear seat in plan view; and a closure panel mounted on the deck to close the engine room opening, the closure panel being located below and facing the front and rear seats.

8. The personal watercraft according to claim 7, wherein the closure panel comprises: a panel body provided with an inspection opening; and an inspection cover mounted on the panel body to close the inspection opening, the inspection cover being removable to uncover the inspection opening.

9. The personal watercraft according to claim 7, wherein the closure panel comprises an upper surface, the upper surface comprising a top surface and a recess extending downward from the top surface, and the mounting adjuster is located in a space defined by the recess.

10. The personal watercraft according to claim 9, wherein at least a portion of a bottom surface of the recess is a horizontal surface that extends in a horizontal direction when the personal watercraft is at rest on the water, and an edge of the horizontal surface is smoothly continuous with the top surface.

11. The personal watercraft according to claim 1, wherein the mounting adjuster comprises: a positioner configured to place the straddle seat on the watercraft body in a mounting position selected from the plurality of mounting positions arranged in the front-rear direction; and a lock configured to lock the straddle seat to the watercraft body.

12. The personal watercraft according to claim 11, wherein the positioner comprises: at least one positioning projection provided in one of the watercraft body and the straddle seat and projecting toward the other of the watercraft body and the seat; and at least one positioning hole provided in the other of the watercraft body and the straddle seat and opening toward the one of the watercraft body and the straddle seat, the at least one positioning projection includes a plurality of positioning projections or the at least one positioning hole includes a plurality of positioning holes arranged in the front-rear direction, and the lock comprises: an engagement receiving structure provided in the or each positioning projection; a plurality of engaging structures provided in the other of the watercraft body and the seat and associated with the positioning hole or holes; and a user operable structure operable to disengage the engaging structure from the engagement receiving structure.

13. The personal watercraft according to claim 12, wherein the engaging structures and the user operable structure are provided in the straddle seat.

14. The personal watercraft according to claim 12, wherein the user operable structure is connected to the engaging structures in such a manner as to transmit a drive force to the engaging structures and cause the engaging structures to move together.

15. The personal watercraft according to claim 1, wherein the straddle seat comprises a hand grip.

16. The personal watercraft according to claim 15, wherein the at least one mounting adjuster includes a pair of mounting adjusters associated with the straddle seat comprising the hand grip, the pair of mounting adjusters being spaced apart from each other.

* * * * *